United States Patent [19]

Longerich et al.

[11] Patent Number: 4,998,688

[45] Date of Patent: Mar. 12, 1991

[54] OPERATING TEMPERATURE HYBRIDIZING FOR FOCAL PLANE ARRAYS

[75] Inventors: Ernest P. Longerich, Chatsworth; Saverio A. D'Agostino, Camarillo, both of Calif.

[73] Assignee: Hughes Aircraft Company, Los Angeles, Calif.

[21] Appl. No.: 373,117

[22] Filed: Jun. 29, 1989

[51] Int. Cl.[5] ..... F42B 15/01; H01H 71/18

[52] U.S. Cl. ..... 244/3.16; 250/332; 250/349; 250/352; 250/370.08; 250/370.15; 337/140

[58] Field of Search ..... 337/140; 244/3.16; 250/332, 349, 352, 370.08, 370.15

[56] References Cited

U.S. PATENT DOCUMENTS

| | | | |
|---|---|---|---|
| 4,039,833 | 8/1977 | Thom | 250/332 |
| 4,304,294 | 12/1981 | Reisman et al. | 165/32 |
| 4,695,715 | 9/1987 | Malm | 250/211 J |

FOREIGN PATENT DOCUMENTS

| | | | |
|---|---|---|---|
| 1194188 | 9/1985 | Canada | 244/3.16 |
| 0008503 | 3/1980 | European Pat. Off. | 244/3.16 |
| 997120 | 2/1983 | U.S.S.R. | 337/382 |

*Primary Examiner*—Constantine Hannaher

*Attorney, Agent, or Firm*—C. D. Brown; R. M. Heald; W. K. Denson-Low

[57] ABSTRACT

A detector array assembly which provides for the closing at operating temperature of normally open contacts between individual sensor contact mesas and readout pads of the respective detector and readout chips comprising a detector array assembly. One or more shape memory separator elements are used in conjunction with one or more biasing springs to control the spacing of the contacts. The force of the biasing spring becomes the dominant force as the apparatus is cooled down to near operating temperature, thus moving the chips closer together and establishing reliable electrical connection between the opposed sets of contacts. At temperatures near and above the normal operating temperature of 77 degrees K., the shape memory separator element provides the dominant force and drives the chips apart to open the contacts.

27 Claims, 2 Drawing Sheets

FIG. 1
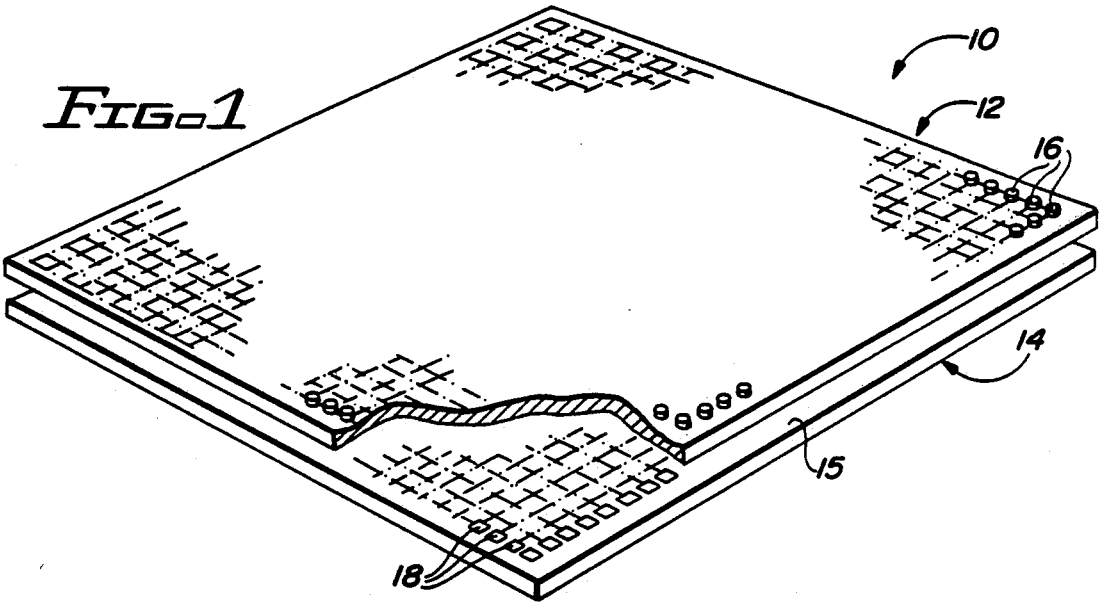
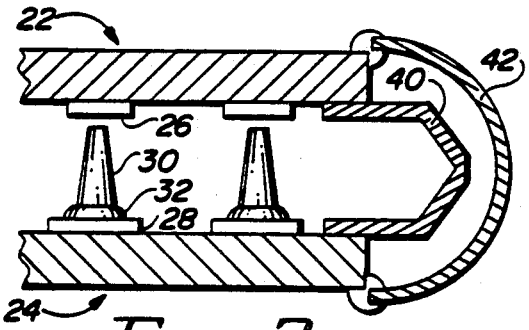
FIG. 2
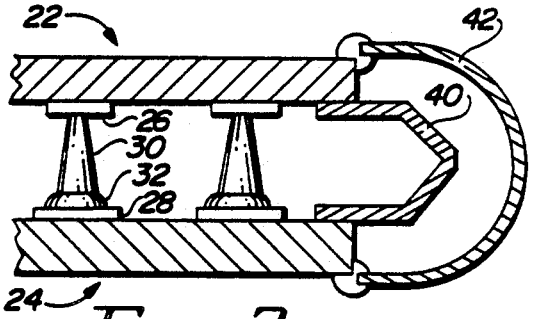
FIG. 3
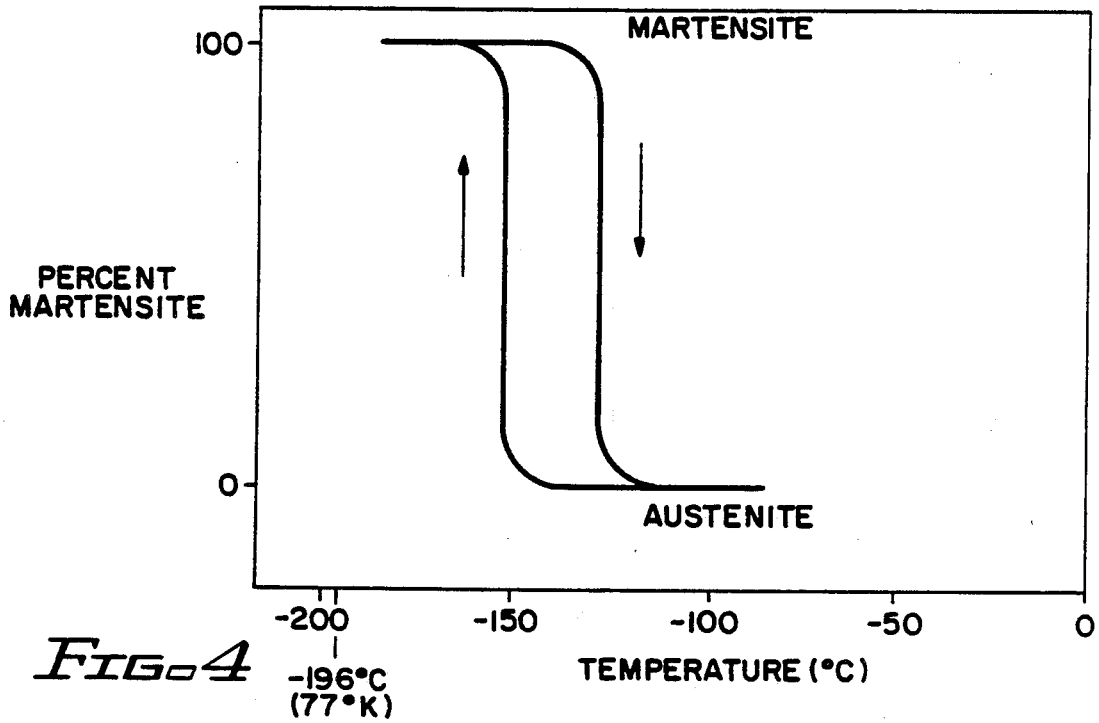
FIG. 4

OPERATING TEMPERATURE HYBRIDIZING FOR FOCAL PLANE ARRAYS

BACKGROUND OF THE INVENTION

1. Field of the Invention

This invention relates to electrical connectors for infrared detectors and, more particularly, to arrangements for improving the reliability of connections to a plurality of sensors in a detector array assembly which is subject to thermal fatigue from temperature cycling.

2. Description of the Related Art

In the present fabrication of focal plane arrays for infrared sensing systems, the hybrid detector array assembly comprises a pair of microchips, one bearing the array of sensors and the other bearing a corresponding array of cells or diodes with associated contact pads to provide the readout of individual sensor signals. The contact pairs of the two microchips are joined together in a process called hybridization. In this process, a plurality of indium bumps on the detector chip and a corresponding plurality of indium bumps on the readout chip are cold welded together by pressure Once joined, they are no longer separable and the breaking of any weld constitutes a failure of that readout cell.

Over time an infrared detector array is repeatedly cycled between room temperature and its normal operating temperature of 77 degrees K. This repeated temperature cycling is responsible for problems relating to thermal fatigue which results from the different coefficients of thermal expansion in the different materials present in the hybrid detector assembly.

In the present (prior art) fabrication process, the indium bumps are made by vapor deposition through a photo-reduced mask pattern and have a typical height of 6–9 microns. It is not possible to deposit the indium bumps more than 10 microns high with acceptable quality and density. Over the temperature cycling range between room temperature and 77 degree K. operating temperature, the various materials present in the array account for the thermal fatigue problems. For example, the readout chip is a silicon substrate with contact pads approximately 0.00016 centimeter square on 0.0008 centimeter inch spacing. A typical array may have 128×128 cells. The sensors are arranged in a similar array on a cadmium telluride substrate. Because of the differences in thermal expansion and contraction between the detector chip and readout chip, repeated temperature cycling results in various failure modes: contact pads are pulled away from the substrate, pieces of contacts break off, the cold welded junctions of the indium bumps fracture and separate, the stresses induced by the differential thermal expansion or contraction of the substrates may cause warpage of the array chips, and the like.

Arrangements in accordance with the present invention incorporate a particular material known as a shape memory alloy in a novel arrangement to overcome some of the problems described hereinabove. Shape memory alloys are a unique family of metals which exhibit a temperature dependent shape change. They can be deformed from 5 to 8 percent in tension, compression or shear. Upon heating beyond a critical temperature, the metal returns to its original "memory" shape and, if resisted, can generate stresses as high as 100 kpsi. Stresses, strains, transition temperatures and other parameters of such materials can be controlled by composition and processing to tailor the material to provide particular performance characteristics in a given application.

This unusual effect of shape memory depends upon the occurrence of a specific type cf phase change known as martensitic transformation. Martensite forms on cooling from the high temperature phase, termed austenite, by a shear type of process. The curves of deformation with temperature and stress exhibit a hysteresis effect. Shape memory alloy products have been produced by Raychem Corporation, Menlo Park, Calif. The materials of interest here are sold by Raychem under the trademark Tinel.

SUMMARY OF THE INVENTION

In brief, arrangements in accordance with the present invention incorporate a shape memory separator element in combination with a biasing spring member to control the opening and closure of connections between the multiple sensors of a detector array and the corresponding plurality of contact points of an associated readout chip. A closure spring is mounted between the detector array and the readout chip such that the spring force biases the two chips toward a closure position for the respective contact elements. A shape memory separator is mounted between the detector array and the readout chip, developing a force which opposes the biasing force of the closure spring. The separating force of the shape memory separator exceeds the spring force at room temperature and below, down to a temperature which is close to the operating temperature of 77 degrees K. However, the shape memory separator changes shape at a point near the operating temperature of the device so that the biasing force of the spring dominates at operating temperature. Thus, when the device is near or at operating temperature, the contact points of the detector array and the silicon readout chip are mechanically and electrically connected.

By virtue of this arrangement, the thermal stresses between the detector array and the readout chip are virtually eliminated over the major range of the temperature cycle from room temperature to 77 degrees K. because for most of this range there is no contact between the detector array and the readout chip. Only when the apparatus is at and near the operating temperature are the contacts of the detector array and the silicon readout mechanically and electrically connected.

The elimination of thermal stresses between the two elements of the focal plane array substantially improves the thermal cycle lifetime of the device. Improved reliability of the electrical connections is achieved. In addition, the lack of permanent connections between the contact pairs of the detector array which is achieved with the arrangement of the present invention avoids the necessity of discarding an entire detector array assembly upon the discovery of a faulty sensor. In such a case, only the detector array need be discarded, while the readout chip and the remainder of the assembly can be saved for other apparatus. Alternatively, in the event of a fault detected in the readout chip, the detector array can be salvaged.

BRIEF DESCRIPTION OF THE DRAWINGS

In the accompanying drawings:

FIG. 1 is a schematic view, partially broken away, of a typical hybrid infrared detector assembly of the type to which the present invention is directed;

FIG. 2 is a schematic diagram representing one particular arrangement in accordance with the present invention in a first condition, contacts open, at room temperature;

FIG. 3 is a schematic diagram representing the arrangement of FIG. 2 in a second condition, contacts closed, at operating temperature; and FIG. 4 is an idealized representation of the operating curve of a shape memory device such as is used in the arrangement of FIGS. 2 and 3.

DESCRIPTION OF THE PREFERRED EMBODIMENT

Figure 5:
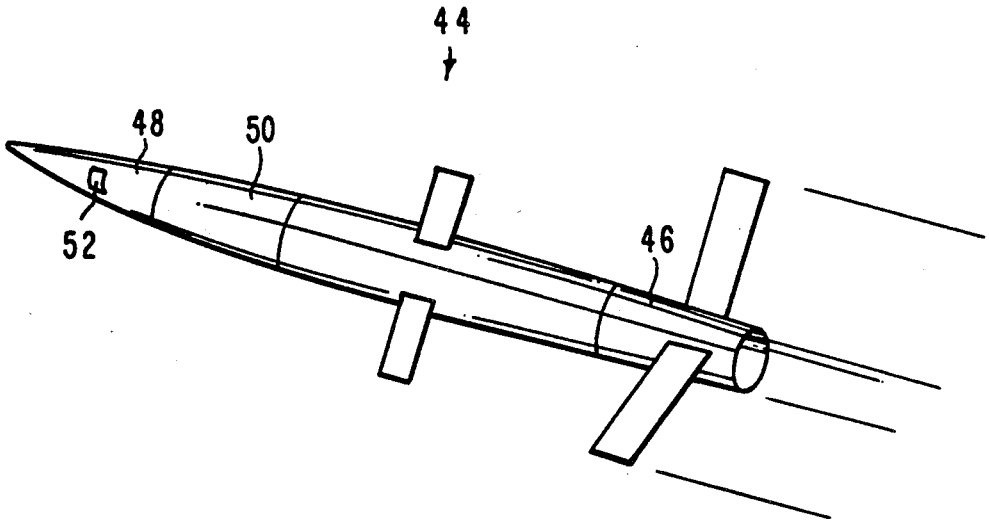
FIG. 5 is a schematic view of a missile incorporating the present invention.

As indicated in the schematic representation of FIG. 1, a conventional hybrid infrared detector assembly 10, to which the present invention is directed, may comprise a detector array 12 generally aligned with a readout chip 14. The detector array 12 comprises a plurality of individual sensors 16, shown here in a square array, which may typically be a 128×128 array for a total of 16,384 individual sensors. The readout chip 14 is typically a silicon substrate 15 bearing a corresponding plurality of usually square pads 18, typically 0.00016 centimeter inch square, with 0.002 inch center-to-center separations. These pads may be fashioned of multiple layers of various contact metals with gold plating applied as a thin coating layer. Typically, indium bumps (not shown) are located on the respective pads 18 and on the facing connections to the sensors 16 and the detector and readout chips 12, 14 are brought together such that the indium bumps on facing aligned contact elements are cold welded together by pressure Once joined in this fashion, the bump connections are not separable in normal operation.

The chips 12 and 14 are of necessity constructed of different materials, e.g. cadmium telluride and silicon, which have different coefficients of thermal expansion. In rise, the hybrid infrared detector 10 is regularly cycled over a temperature range of about 220 degrees C. (room temperature to operating temperature of 77 degrees K. and return). Because of the differences in the degree of expansion or contraction with temperature of the disparate materials in the two chips 12, 14, it will be appreciated that significant shear forces may develop at the various contacts which may result in breaking of the indium bump welds, fracture of contact metals or other contact connections, warping the substrates and the like.

FIGS. 2 and 3 schematically represent one particular arrangement in accordance with the present invention which is designed to alleviate the problem of contact failure due to thermal fatigue of devices such as that shown and described in connection with FIG. 1. FIGS. 2 and 3 represent a portion of a detector array comprising a detector chip 22 and a readout chip 24. Individual sensor contacts 26 are shown on the underside of the detector chip 22; individual contact pads 28 are shown in position in the upper surface of the readout chip 24. Each pad 28 is shown with an extension tube 30 mounted thereon by an indium or metallic solder bump 32 on top of the pad 28. The two chips 22, 24 are positioned, relative to each other, by a combination structure comprising a shape memory separator element 40 and a biasing spring 42. In one particular embodiment, the contacts 26 are metallized mesas and extension tubes 30 are of nickel with a layer of gold plating. The pads 28 may be of copper, gold plated. In an alternative embodiment, the contacts 26 are gold metallized mesas and the tubes 30 are gold.

The shape memory separator element 40 is constructed of a particular material which, as noted hereinabove, has the property of changing shape in non-linear fashion as it transitions a threshold temperature.

This unusual effect of shape memory depends upon the occurrence of a specific type cf phase change known as martensitic transformation. Martensite forms on cooling from the high temperature phase, termed austenite, by a shear type of process. The curves of deformation with temperature and stress exhibit a hysteresis effect. Shape memory alloy products have been produced by Raychem Corporation, Menlo Park, Calif. The materials of interest here are sold by Raychem under the trademark Tinel.

The transition temperature at which the material transforms from martensite to austenite is controlled by alloy composition and processing. FIG. 4 shows the idealized transformation curves for one particular alloy. There is a hysteresis between the heating curve, martensite to austenite, and the cooling curve, austenite to martensite. For this material, the shape memory element is austenite at room temperature. The shape memory separator element 40 is shown in room temperature condition in FIG. 2, expanding the dimension between the two chips 22, 24 and overcoming the biasing force of the spring 42 tending to push the chips 22, 24 toward each other. As the temperature of the shape memory element 40 is reduced, approaching the operating temperature of 77 degrees K., the element undergoes a transition along the left-hand curve of FIG. 4 in the direction of the upward facing arrow, converting from austenite to martensite. Near the upper end of this curve, the element 40 relaxes to the point where the biasing force of the spring 42 becomes the dominant force which is applied to the chips 22, 24. Thus, the chips 22, 24 are moved toward each other and the contact extension tubes 30 are brought into contact with the metallized mesas of the detector array 22 in a firm, reliable connection. Circuit connections between the mesas 26 and the extension tubes 30 of the readout pads 28 are maintained until the device is removed from the operating temperature range, at which point the force of the shape memory separator element 40 becomes dominant and drives the contact members apart. Since this change in dimension of the shape memory separator element 40 occurs in non-linear fashion at a temperature near and slightly above the operating temperature of 77 K., the opposing contact members are separated over most of the temperature cycle between room temperature and operating temperature. Thus, the stresses which are encountered in previously known devices, such as that depicted in FIG. 1., due to temperature expansion and contraction over the entire temperature range of approximately 220 degrees C. are not present in embodiments of the present invention.

A further benefit of arrangements in accordance with the present invention results from the fact that these arrangements do not involve permanent connections between indium bumps at opposed contact pairs, the sensor mesa contacts and the readout pads. As a result, a given detector array such as the chip 22 may undergo quality testing using a readout chip in an arrangement such as that which is represented in FIGS. 2 and 3. If a defective sensor is detected, the detector array 22 may be discarded without the loss of the associated readout chip and related circuitry. In the past, when the detector and readout chip contacts were welded together, the existence of a single defective sensor required discarding the attached readout chip as well.

The extension elements 30 are provided as a further mechanism for relieving contact stress from thermal cycling. Because they increase the spacing between the sensor mesas and the corresponding readout pads and introduce some lateral compliance to the structure, they tend to further relieve the lateral stress resulting from that limited thermal expansion and contraction which occurs after the pairs of opposed contact elements are brought together at near the operating temperature of the device, as depicted in FIG. 3.

These contact extension tubes 30 may be fashioned by forming a sandwich or laminate of three layers of two different, differentially etchable materials. A laser is used to drill holes through the laminate in a pattern corresponding to the detector array, followed by through-hole plating with copper or some other suitable material to form a plurality of tiny tubes. The top and bottom layers of the laminate are then removed by etching, leaving the middle layer as a polymer film with the metal tubes protruding above and below. After the extension tubes 30 are installed on the indium bumps of the readout pads 28 as indicated in FIG. 2, the carrier film may be removed by a further etching step.

There are a variety of materials that exhibit the shape memory effect. The most common, and useful, shape memory metal is a near stoichiometric alloy of nickel and titanium, commonly referred to as Nitinol Nickel-titanium alloys of various compositions and configurations are marketed by Raychem under its trademark Tinel.

For the shape memory separator element, the temperature responsive properties can be tailored to develop a particular critical temperature Stresses, strains, transition temperatures and similar parameters can be controlled by selection and proportions of the metals making up the shape memory alloys and by the processing of the alloy during fabrication.

The biasing spring which is used in conjunction with the shape memory separator element may be formed of various selected materials, including stainless steel, titanium, selected copper alloys and composites. The choice of composition cf the biasing spring will depend in part on the temperature of operation of the apparatus. The mechanical properties of the spring can be tailored to the need of the apparatus, according to the knowledge of those of ordinary skill in the art.

FIGS. 2 and 3 are merely schematic representations of the shape memory separator element 40 and biasing spring 42 of the present invention. It will be understood that the actual structural configuration of a detector array assembly incorporating these elements may be quite different from what is schematically represented in FIGS. 2 and 3. The spring, for example, may comprise a plurality of springs positioned along the upper and lower faces of the chips 22, 24 to support the array assembly within a support frame (not shown). Preferably the shape memory separator element 40 will be symmetrically disposed relative to the two chips 22, 24. Separator elements might be placed at the opposite ends of the array assembly or they could be mounted evenly spaced about the periphery of such an assembly.

Arrangements in accordance with the present invention advantageously alleviate particular problems presently encountered in detector arrays operated at very cold temperatures which occur because of the effects of mismatch of the temperature coefficients of expansion of the disparate materials which are employed. The present invention makes it possible to improve the reliability in operation of such apparatus over the multiple cool down cycles which the apparatus encounters during its operating lifetime. Substantial cost savings may be effected in production as well as in operating maintenance of these arrangements, since the present invention permits the quality testing of detector arrays and the discarding of same if defective, before they are dedicated to installation in a complete detector array assembly. It is also expected that arrangements in accordance with the present invention will exhibit improved resistance to shock and acceleration forces which may be encountered during normal operation of the detector assembly.

As shown in FIG. 5 a particular useful application of the present invention is a missile 44 having a propulsion system 46, a guidance system 48 and a payload 50. As shown, the guidance system 48 includes a hybrid detector assembly 52 for sensing infrared radiation. Although there have been shown and described hereinabove specific arrangements incorporating operating temperature hybridizing for focal plane arrays in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. Apparatus for controlling the contact closures of respective arrays of opposing contact pairs comprising:

a first array of contact elements positioned along a first planar member;

a second array of contact elements extending along a second planar member in opposing juxtaposition respectively aligned with the contact elements of the first array; and means including a shape memory element for closing the respectively aligned contact pairs for temperatures in a range on one side of a selected transition temperature in a range on the other side of said selected transition temperature, said means including biasing spring means operative in conjunction with said shape memory element to provide a net biasing force in a first direction for temperatures below said transition temperature and a net biasing force in a second direction opposite to the first direction for temperatures above said selected transition temperature.

2. The apparatus for claim 1 wherein the operating temperature of the apparatus is selected to be substantially below standard room temperature.

3. The apparatus of claim 2 wherein the selected operating temperature of the apparatus is approximately 77 degrees Kelvin and the selected transition temperature of the shape memory element is slightly above said selected operating temperature.

4. The apparatus of claim 2 wherein the respective forces generated by the biasing spring means and the shape memory element are such that the biasing spring force becomes dominant at the selected operating temperature of the apparatus.

5. The apparatus of claim 2 wherein the interrelationship of the biasing spring means and the shape memory element is such that the force exerted by the shape memory element becomes dominant for temperatures above the selected operating temperature by a predetermined amount.

6. The apparatus of claim 5 wherein said biasing spring means comprise at least one spring extending between the first and second planar members and mounted thereto in a manner to bias said members toward each other.

7. The apparatus of claim 6 wherein said shape memory element comprises a separator element coupled between said first and second members and mounted thereto in a manner to urge the first and second members away from each other.

8. The apparatus of claim 1 wherein the shape memory element is constructed as a shape memory separator element and is mounted between the first and second planar members in a manner to urge said members apart for temperatures in a range above said selected transition temperature.

9. Apparatus for controlling the contact closures of respective arrays of opposing contact pairs comprising:

a first array of contact elements positioned along a first planar member, said first member including a detector array having a plurality of infrared sensors mounted thereon with contacts facing toward said second member and said second member including a readout device having a like plurality of contact pads mounted thereon facing toward said first member, said contact pads and contacts being respectively aligned by pairs in facing juxtaposition with each other;

a second array of contact elements extending along a second planar member in opposing juxtaposition respectively aligned with the contact elements of the first array, said first member including a detector array having a plurality of infrared sensors mounted thereon with contacts facing toward said second member and said second member including a readout device having a like plurality of contact pads mounted thereon facing toward said first member, said contact pads and contacts being respectively aligned by pairs in facing juxtaposition with each other;

means including a shape memory element for closing the respectively aligned contact pairs for temperatures in a range on one side of a selected transition temperature in a range on the other side of said selected transition temperature; and a like plurality of contact extension tubes respectively mounted on corresponding ones of said plurality of contact pads.

10. The apparatus of claim 9 further including a like plurality of indium bumps affixing said extension tubes to said contact pads.

11. The apparatus of claim 9 further including a like plurality of metallic solder elements affixing said extension tubes to said contact pads.

12. A hybrid detector assembly for sensing infrared radiation comprising:

a detector module including a plurality of infrared sensors coupled respectively to a first array on contact elements positioned along a first planar member;

a readout module including a second array of contact elements extending along a second planar member in opposing juxtaposition respectively aligned with the contact elements of the first array; and means including a shape memory element for closing the respectively aligned contact pairs for temperatures in a range on one side of a selected transition temperature and opening said contact pairs for temperatures in a range on the other side of said selected transition temperature said means including biasing spring means operative in conjunction with said shape memory element to provide a net biasing force in a first direction for temperatures below said transition temperature and a net biasing force in a second direction opposite to the first direction for temperatures above said selected transition temperature.

13. The assembly of claim 12 wherein the operating temperature of the apparatus is selected to be substantially below standard room temperature.

14. The assembly of claim 13 wherein the selected operating temperature of the apparatus is approximately 77 degrees Kelvin and the selected transition temperature of the shape memory element is slightly above said selected operating temperature.

15. The assembly of claim 13 wherein the respective forces generated by the biasing spring means and the shape memory element are such that the biasing spring force becomes dominant at the selected operating temperature of the apparatus.

16. The assembly of claim 13 wherein the interrelationship of the biasing spring means and the shape memory element is such that the force exerted by the shape memory element becomes dominant for temperatures above the selected operating temperature by a predetermined amount.

17. The assembly of claim 16 wherein said biasing spring means comprise at least one spring extending between the first and second planar members and mounted thereto in a manner to bias said members toward each other.

18. The assembly of claim 17 wherein said shape memory element comprises a separator element coupled between said first and second members and mounted thereto in a manner to urge the first and second members away from each other.

19. The assembly of claim 12 wherein the shape memory element is constructed as a shape memory separator element and is mounted between the first and second planar members in a manner to urge said members apart for temperatures in a range above said selected transition temperature.

20. A missile having a propulsion system, a guidance system and a payload wherein the guidance system includes a hybrid detector assembly for sensing infrared radiation, which assembly comprises:

a first array of contact elements positioned along a first planar member;

a second array of contact elements extending along a second planar member in opposing juxtaposition respectively aligned with the contact elements of the fist array; and means including a shape memory element for closing the respectively aligned contact pairs for temperatures in a range on one side of a selected transition temperature in a range on the other side of said selected transition temperature, said means including biasing spring means operative in conjunction with said shape memory element to provide a net biasing force in a first direction for temperatures below said transition temperature and a net biasing force in a second direction opposite to the first direction for temperatures above said selected transition temperature.

21. The missile of claim 20 wherein the operating temperature of the assembly is selected to be substantially below standard room temperature.

22. The missile of claim 21 wherein the selected operating temperature of the assembly is approximately 77 degrees Kelvin and the selected transition temperature of the shape memory element is slightly above said selected operating temperature.

23. The missile of claim 21 wherein the respective forces generated by the biasing spring means and the shape memory element are such that the biasing spring force becomes dominant at the selected operating temperature of the assembly.

24. The missile of claim 21 wherein the interrelationship of the biasing spring means and the shape memory element is such that the force exerted by the shape memory element becomes dominant for temperatures above the selected operating temperature by a predetermined amount.

25. The missile of claim 24 wherein said biasing spring means comprise at least one spring extending between the first and second planar members and mounted thereto in a manner to bias said members toward each other.

26. The missile of claim 25 wherein said shape memory element comprises a separator element coupled between said first and second members and mounted thereto in a manner to urge the first and second members away from each other.

27. The missile of claim 20 wherein the shape memory element is constructed as a shape memory separator element and is mounted between the first and second planar members in a manner to urge said members apart for temperatures in a range above said selected transition temperature.

* * * * *